US010343813B2

(12) United States Patent
Macià Trepat

(10) Patent No.: US 10,343,813 B2
(45) Date of Patent: Jul. 9, 2019

(54) CONTAINER WITH FOLD-OUT OPENING

(71) Applicant: Tecnografica Y Maquinaria, S.A., Barcelona (ES)

(72) Inventor: Josep Macià Trepat, Castellbell i el Vilar (ES)

(73) Assignee: TECNOGRAFICA Y MAQUINARIA, S.A., Barcelona (ES)

( * ) Notice: Subject to any disclaimer, the term of this patent is extended or adjusted under 35 U.S.C. 154(b) by 25 days.

(21) Appl. No.: 15/323,984

(22) PCT Filed: Apr. 14, 2015

(86) PCT No.: PCT/ES2015/070299
§ 371 (c)(1),
(2) Date: Jan. 5, 2017

(87) PCT Pub. No.: WO2016/005623
PCT Pub. Date: Jan. 14, 2016

(65) Prior Publication Data

US 2017/0203873 A1 Jul. 20, 2017

(30) Foreign Application Priority Data

Jul. 8, 2014 (ES) ..... 201431023

(51) Int. Cl.
*B65D 5/70* (2006.01)
*B65D 5/54* (2006.01)
(Continued)

(52) U.S. Cl.
CPC ..... *B65D 5/701* (2013.01); *B65D 5/06* (2013.01); *B65D 5/062* (2013.01); *B65D 5/541* (2013.01);
(Continued)

(58) Field of Classification Search
CPC .. B65D 5/701; B65D 17/462; B65D 17/4012; B65D 17/404; B65D 5/06; B65D 5/541;
(Continued)

(56) References Cited

U.S. PATENT DOCUMENTS 2,975,952 A * 3/1961 Tamarin ..... B65D 5/723 229/220
3,003,673 A * 10/1961 Clark ..... B65D 5/742 229/217
(Continued)

*Primary Examiner* — Christopher R Demeree
(74) *Attorney, Agent, or Firm* — Thedford I Hitaffer; Hitaffer & Hitaffer, PLLC

(57) ABSTRACT

Container with fold-out opening, resulting from the suitable bending and folding of a laminar body that has bending lines that define four rectangular walls, which have a common upper flap and another, common lower flap with bending lines; the upper flap has two folding lines that continue two transverse bending lines defining a wall that is in a central position; said folding lines defining three rectangular portions of the upper flap; the central portion having the same axis of symmetry as the central wall; each of the portions is provided with additions opposite the contact thereof with the walls; the addition having a tear line that divides the addition into two dividing parts; the portion having a slot and the addition having a tab in the dividing part thereof and which can be engaged and inserted into the slot.

17 Claims, 9 Drawing Sheets

(51) Int. Cl.

| | |
|---|---|
| ***B65D 17/00*** | (2006.01) |
| ***B65D 5/06*** | (2006.01) |
| ***B65D 17/46*** | (2006.01) |
| ***B65D 17/28*** | (2006.01) |
| ***B65D 5/74*** | (2006.01) |

(52) U.S. Cl.
CPC ..... *B65D 5/742* (2013.01); *B65D 17/404* (2018.01); *B65D 17/4012* (2018.01); *B65D 17/462* (2018.01); *B65D 2517/0013* (2013.01)

(58) Field of Classification Search
CPC ..... B65D 17/165; B65D 17/20; B65D 17/24; B65D 5/062; B65D 5/742; B65D 5/065; B65D 5/743; B65D 5/745
USPC ..... 229/200, 217, 216, 125.42, 214, 248, 229/101.2, 215, 241, 915.1; 222/476, 222/556; D9/417
See application file for complete search history.

(56) References Cited

U.S. PATENT DOCUMENTS 3,095,135 A * 6/1963 Hennessey ..... B65D 5/742 229/125.42
3,147,904 A * 9/1964 Larson ..... B65D 5/062 229/137
3,237,842 A * 3/1966 Esse ..... B65D 5/541 229/237
3,767,107 A * 10/1973 Forbes, Jr. ..... B65D 5/742 222/556
4,520,929 A * 6/1985 Lisiecki ..... B65D 5/062 229/216
4,582,246 A * 4/1986 Lisiecki ..... B65D 5/062 229/137
4,657,143 A * 4/1987 Forbes, Jr. ..... B65D 5/062 229/212
4,732,275 A * 3/1988 Hambleton ..... B65D 5/065 229/216
5,014,854 A * 5/1991 Anderson ..... B65D 5/062 229/214
5,234,160 A * 8/1993 Lisiecki ..... B65D 5/062 229/136
5,246,162 A * 9/1993 Heuberger ..... B65D 5/062 229/117.31
7,503,475 B2 * 3/2009 McGowan ..... B65D 5/723 222/476
7,614,543 B1 * 11/2009 Miller ..... B65D 71/36 206/45.2
8,800,855 B2 * 8/2014 Fitzwater ..... B65D 5/0227 229/129.1
9,051,076 B2 * 6/2015 Ahsan ..... B65D 5/5475
9,505,520 B2 * 11/2016 Baker ..... B65D 5/0227
2006/0255107 A1 * 11/2006 Wright ..... B65D 5/0005 229/101.2

* cited by examiner

CONTAINER WITH FOLD-OUT OPENING

RELATED APPLICATIONS

This application is a National Phase of PCT Patent Application No. PCT/ES2015/070299 having International filing date of Apr. 14, 2015, which claims the benefit of priority of Spanish Patent Application No. P201431023 filed on Jul. 8, 2014. The contents of the above applications are all incorporated by reference as if fully set forth herein in their entirety.

OBJECT OF THE INVENTION

The object of the present patent application is to register a container with fold-out opening, which incorporates notable innovations and advantages over the techniques used hitherto.

More specifically, the invention proposes the development of a container with fold-out opening, which due to the particular arrangement thereof, enables the manual creation of an opening in the container itself, and also the subsequent manual closing thereof, according to the user's needs.

FIELD AND BACKGROUND OF THE INVENTION

Known containers for manual use, containers for granulated or liquid products, such as detergent powders, liquid soap, detergents, food products, etc. are known in the current state of the art.

These containers are extensively used, although they have some drawbacks in the manual opening and closing thereof by the user.

The opening is sometimes a little difficult and the subsequent manual closing for subsequent uses is not completely effective and secure.

Moreover, these containers do not exploit all of the inner geometric volume, especially due to the existence of a manual opening system.

The dosage and pouring of the inner content of the container presents some difficulties in order for the user to achieve adequate accuracy in said dosage and pouring.

The present invention contributes to solving and overcoming the present problem, since it enables the manual opening of a container of the type commonly used for storing and dispensing granulated or liquid contents or products, and the subsequent closing thereof, which is also manual, successively and effectively and securely for the uses of the user, with greater exploitation of the inner geometric volume thereof, as well as a greater and better accuracy in the dosage and pouring of the inner content thereof.

SUMMARY OF THE INVENTION

The present invention has been developed in order to provide a container with fold-out opening, of the type used for storing and dispensing granulated or liquid products, which comprises a vessel with a parallelepiped rectangular configuration, said vessel resulting from the suitable bending and folding of a laminar body, the laminar body having transversal bending lines that define four rectangular walls arranged adjacent to each other, which have an upper flap that is common to them and that defines the upper base of the vessel, and have another, lower flap common to them that is equipped with bending lines, which defines the lower support base of the vessel; and that is essentially characterised by the fact that the upper flap has two folding lines that continue two transverse bending lines defining a wall that is in a central position; said folding lines defining three rectangular portions of the upper flap and are prolongations of each one of the walls respectively; the central portion having the same axis of symmetry as the central wall and being a continuation thereof; and the other two portions being symmetrical with respect to the same axis of symmetry and are a continuation of the walls; each of the two portions is provided with additions on the edges opposite the contact thereof with the walls; an addition having a transversal tear line that divides the addition into two dividing parts, one being further from the axis of symmetry than the other, and the other addition having a free edge that is symmetrical to the tear line with respect to the axis of symmetry; a lateral portion having a slot close to the central portion, and the other addition having a tab in the dividing part thereof closest to the central portion and which can be engaged and inserted into the slot.

Preferably, in the container with fold-out opening, the two folding lines of the upper flap are symmetrical with respect to the axis of symmetry of the wall that is in a central location in the laminar body.

Additionally, in the container with fold-out opening, the central portion of the upper flap has two folding lines that define three triangles, two of them being right-angled triangles, and the lateral portions each have folding lines that define a right-angled triangle adjacent to central portion, the slot in the right-angled triangle being created by one of the folding lines, the addition being trapezoidal shaped with the free edge thereof closest to the central portion being arranged such that it provides a wedge shape to the addition.

Additionally, in the container with fold-out opening, the lateral portions and the additions have folding lines interposed therebetween and that simultaneously delimit the separation thereof, and which are perpendicular to the axis of symmetry.

Preferably, in the container with fold-out opening, the dividing portion of the addition closest to the axis of symmetry has a tongue.

Alternatively, in the container with fold-out opening, two opposite walls are equal to each other, and the other two opposite walls are also equal to each other.

Additionally, in the container with fold-out opening, the folding lines of the central portion are symmetrical with respect to the axis of symmetry thereof.

Additionally, in the container with fold-out opening, the folding lines of the lateral portions are symmetrical with respect to the axis of symmetry.

In addition, in the container with fold-out opening, the folding lines of the lateral portions start their path at the connection point and continue the folding lines of the central wall with the folding lines of the central portion.

Additionally, in the container with fold-out opening, the two folding lines of the central portion start their path at the connection point and continue the folding lines of the central wall with the folding lines of the upper flap.

Alternatively, in the container with fold-out opening, the tear line starts its path at the intersection point between the folding line and the other folding line of the lateral portion interposed between the same portion and the addition thereof.

Preferably, in the container with fold-out opening, the dividing portion of the addition resulting from the path of the tear line and that is furthest from the axis of symmetry, is symmetrical to the addition of the other lateral portion with respect to the same axis of symmetry.

In a condition prior to use, in the container with fold-out opening, the vessel has the dividing portion of an addition of a lateral portion adhered to the other lateral portion by means of a joining means.

Preferably, in the container with fold-out opening, the joining means comprises adhesive glue.

In a condition of use, in the container with fold-out opening, the vessel has an opening delimited by the central and lateral portions.

In a condition prior to the use thereof, in the container with fold-out opening, the tab is engaged and inserted in the slot.

In a condition prior to the use thereof, in the container with fold-out opening, the tongue is bent and/or adhered on a lateral side adjacent to the vessel.

The present invention enables the manual opening of a vessel of the type commonly used for storing and dispensing granulated or liquid contents or products, and the subsequent closing thereof, which is also manual, successively and effectively and securely for the uses of the user, with greater exploitation of the inner geometric volume thereof, as well as a greater and better accuracy in the dosage and pouring of the inner content thereof.

Other characteristics and advantages of the container with fold-out opening will be evident from the description of a preferred, but not exclusive embodiment which is illustrated by way of non-limiting example in the drawings which are included, in which:

DESCRIPTION OF SPECIFIC EMBODIMENTS OF THE INVENTION

Figure 1:
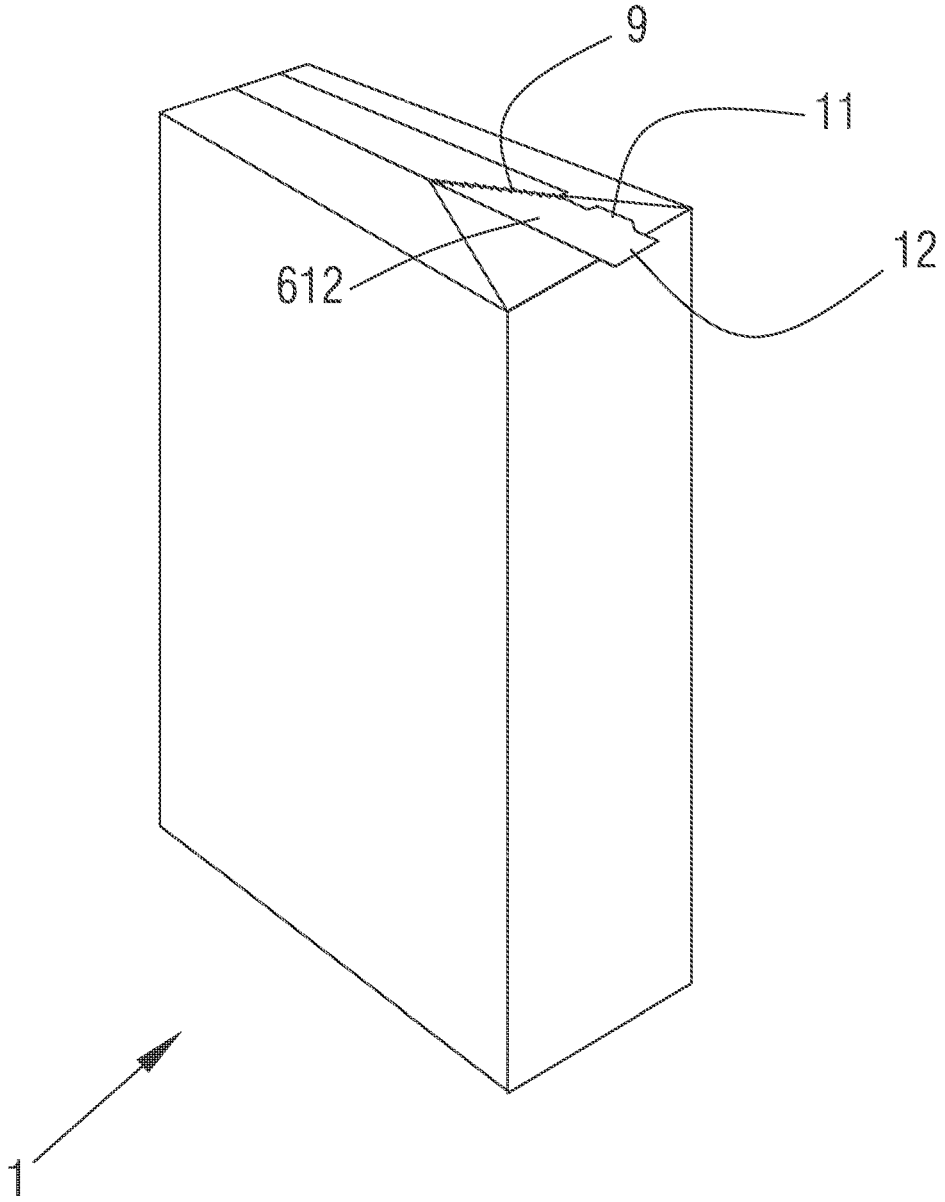
FIG. 1 is a schematic and perspective view of a preferred embodiment of the container with fold-out opening of the present invention, before the manipulation and manual use thereof by the user.

As shown in FIG. 1, the container with fold-out opening is of the type used for storing and dispensing granulated or liquid contents or products.

Figure 2:
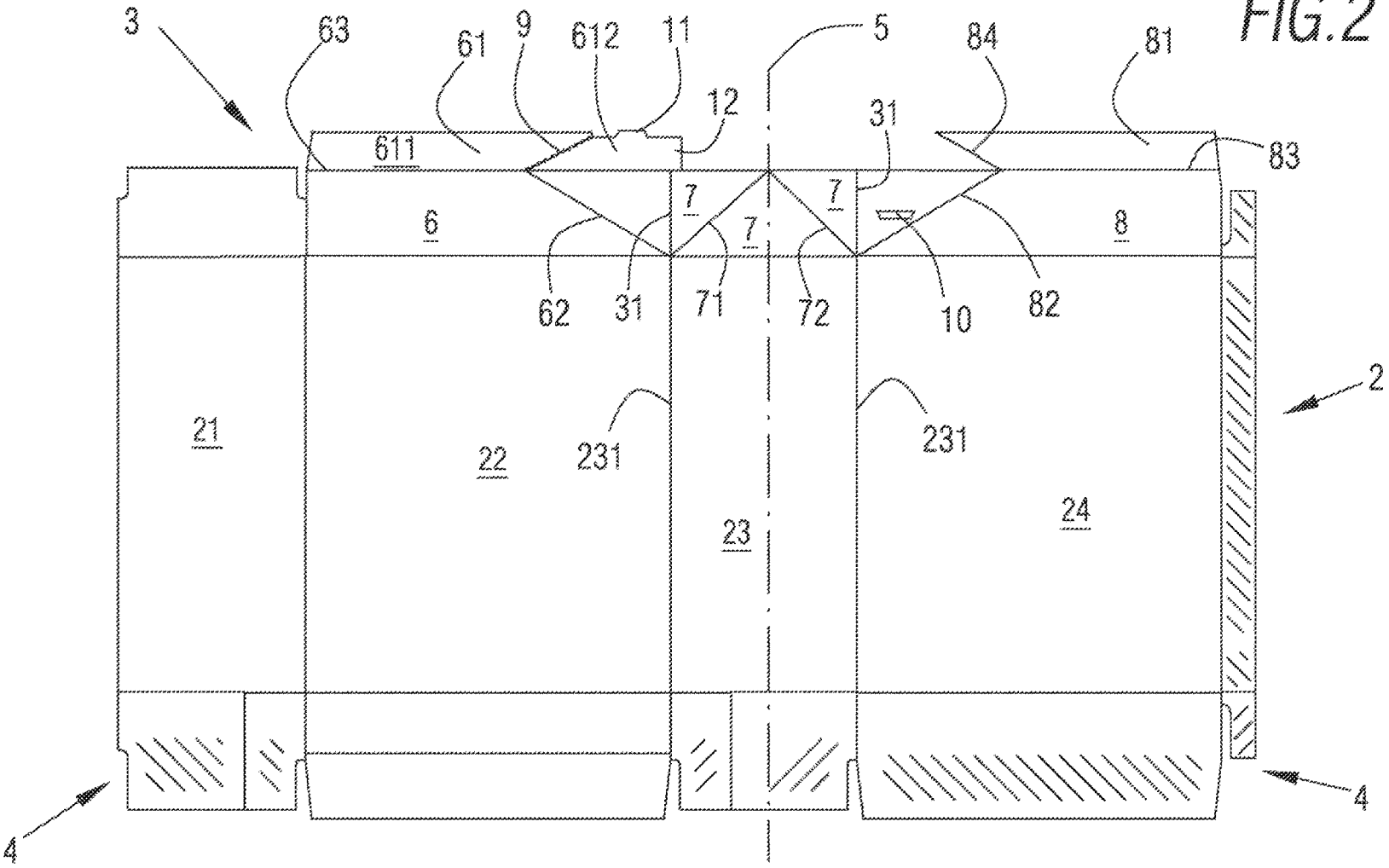
FIG. 2 is a schematic view of a laminar body that constitutes the vessel of the container with fold-out opening of the present invention, that appears extended before the bending and folding thereof, in a preferred embodiment.

It comprises an initially closed vessel 1 with an essentially parallelepiped rectangular configuration, said vessel 1 resulting from the suitable bending and folding of a laminar body 2, which appears extended and represented schematically before the bending and folding thereof in FIG. 2.

The laminar body 2 has transversal bending lines that define four essentially rectangular walls 21, 22, 23, 24 arranged adjacent to each other. After the suitable bending and folding of the laminar body 2, said four walls 21, 22, 23, 24 make up the lateral sides of the vessel 1.

In this preferred embodiment, the four walls 21, 22, 23, 24 are in equal pairs, that is, the two walls 21 and 23 are equal to each other, and the other two walls 22, 24 are all equal to each other.

The walls 21, 22, 23, 24 have an upper flap 3 that is common to them that is equipped with folding lines, which defines the upper base and an opening of the resulting vessel 1, as shall be explained bellow, and have another lower flap 4 that is common to them that is equipped with bending lines, which defines the lower support base of the resulting vessel 1.

The upper flap 3 is equipped with two folding lines 31 that are symmetrical with respect to the axis of symmetry 5 of the central wall 23, said folding lines 31 being a continuation of the two bending lines 231 that define said central wall 23.

Said folding lines 31 define three essentially rectangular portions 6, 7, 8 of the upper flap 3 and which are prolongations of each one of the walls 22, 23, 24 respectively.

The central portion 7 has the same axis of symmetry 5 as the central wall 23 and is a continuation thereof.

The other lateral portions 6, 8 are essentially symmetrical with respect to the axis of symmetry 5 and are a continuation of the walls 22, 24, respectively. Each one of the portions 6, 8 has additions 61, 81 on the edges opposite the contact thereof with the walls 22, 24.

The portions 6, 8 and the additions 61, 81 have folding lines 63, 83 interposed therebetween and that simultaneously delimit the separation thereof, and which are essentially perpendicular to the axis of symmetry 5.

The addition 61 has a transversal tear line 9 that is symmetrical with respect to the axis of symmetry 5 with a free edge 84 of the other addition 81, and therefore dividing the tear line 9 at the addition 61 into two dividing portions 611, 612, one dividing portion 612 being closer to the axis of symmetry 5 than the other dividing portion 611.

The dividing portion 611 resulting from the path of the tear line 9 that is furthest from the axis of symmetry 5, is symmetrical to the addition 81 with respect to the same axis of symmetry 5.

The portion 7 of the upper flap 3 has two folding lines 71, 72 that define three triangles. Two of them are right-angled triangles.

In this preferred embodiment, the two folding lines 71, 72 are symmetrical with respect to the axis of symmetry 5, and start their path at the connection point and continue the bending lines 231 with the folding lines 31.

The portions 6, 8 each have a folding line 62, 82 that defines a right-angled triangle adjacent to central portion 7.

In this preferred embodiment, the folding lines 62, 82 are symmetrical with respect to the axis of symmetry 5, and start their path at the connection point and continue the bending lines 231 with the folding lines 31.

Moreover, the portion 8 has a slot 10 in the right-angled triangle created by the folding line 82.

The addition 81 of the portion 8 is essentially trapezoidal shaped, with the free edge 84 thereof closest to the portion 7 being arranged such that it provides a wedge shape to the addition 81.

The tear line 9 and the free edge 84 are symmetrical with respect to the axis of symmetry 5, and the addition 61 has a tab 11 positioned on the dividing portion 612 thereof closest to the portion 7, and which can be engaged in the slot 10, as shall be seen below.

In this preferred embodiment, the tear line 9 starts its path at the intersection point between the folding line 62 and the other folding line 63 interposed between the portion 6 and the addition 61.

FIGS. 3, 4, 5, 6, 7 and 8 sequentially reproduce the opening process and subsequent closing of the vessel 1.

Before it is handled, the user finds the vessel 1 closed, as seen schematically in FIG. 1, with the slot 10 covered by the tab 11.

Figure 3:
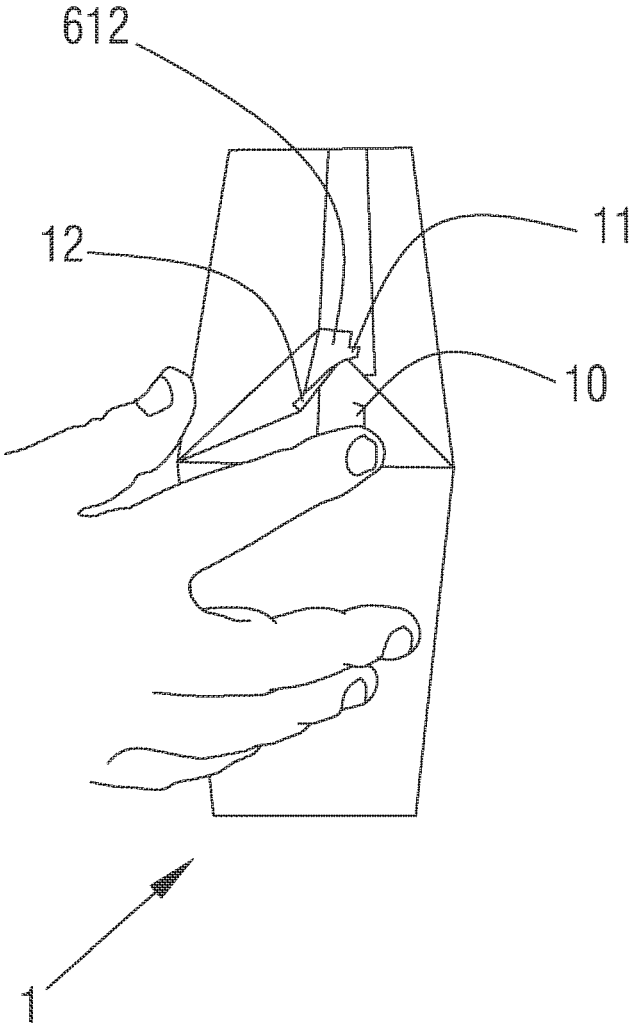
FIGS. 3, 4, 5, 6, 7 and 8 are schematic and sequential views of the opening process and subsequent closing of a preferred embodiment of the container with fold-out opening of the present invention.

Then, the tongue 12 must be manually pulled, as seen schematically in FIG. 3. The tongue 12 is also represented in FIG. 2, with the laminar body 2 extended before the bending and folding thereof to constitute the vessel 1.

The vessel 1, in its ready-to-use arrangement and before the manual manipulation and use thereof by the user, has the dividing portion 612 adhered by means of a joining means to the portion 8, in an area close to the slot 10. In this preferred embodiment, the joining means comprises an adhesive glue, which is not shown in the figures. In this way, the vessel 1 may remain closed when stored and transported before it is delivered to the user.

Figure 4:
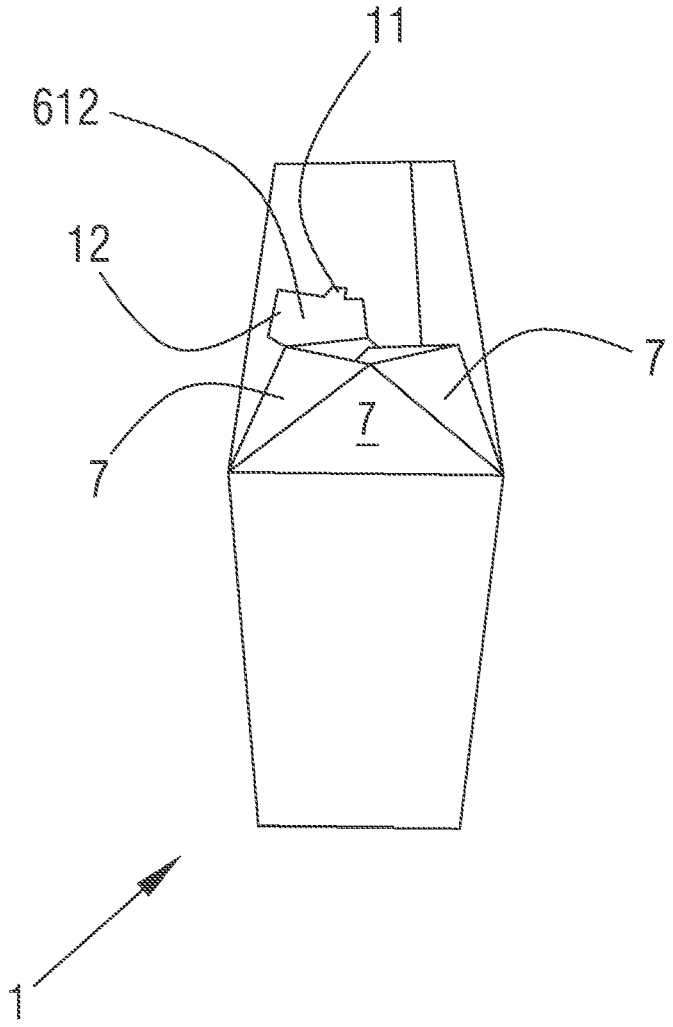

When the tongue 12 is pulled, as well as tearing the adhesive glue that adheres the dividing portion 612 to the portion 8, the tear line 9 breaks, leaving the vessel 1 as shown schematically in FIG. 4, with the portion 7 described in the laminar body 2 oriented towards the inside of the vessel 1.

Figure 5:
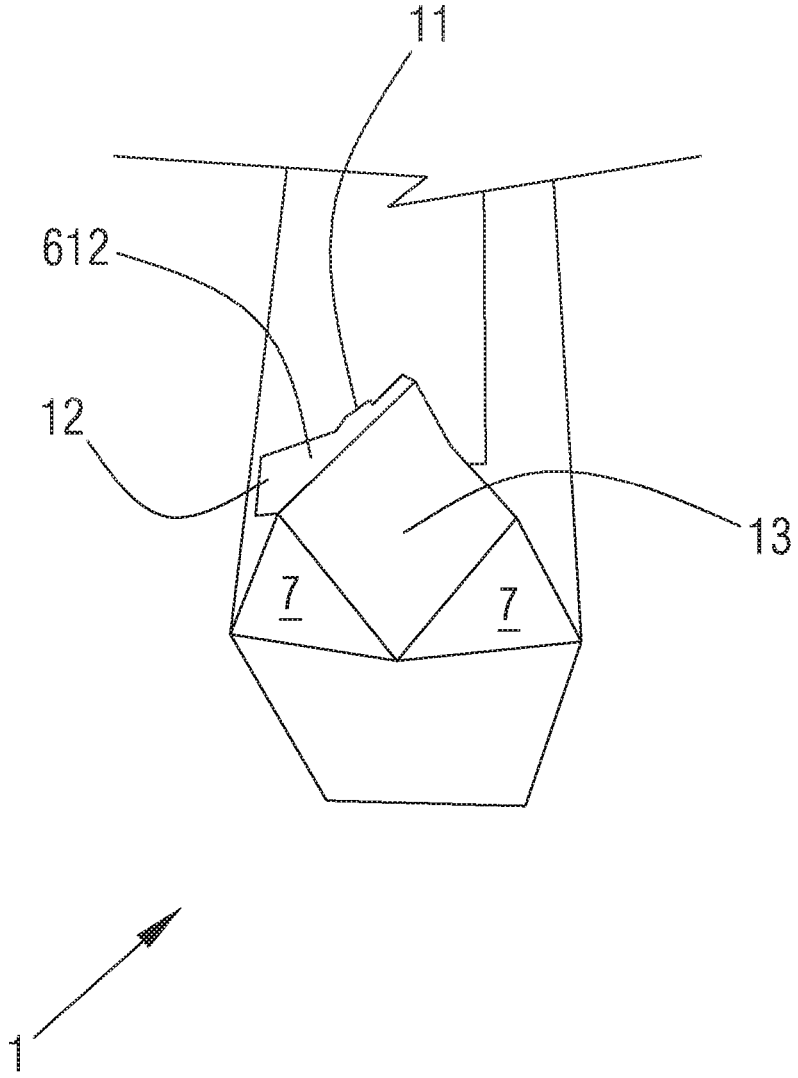
Figure 6:
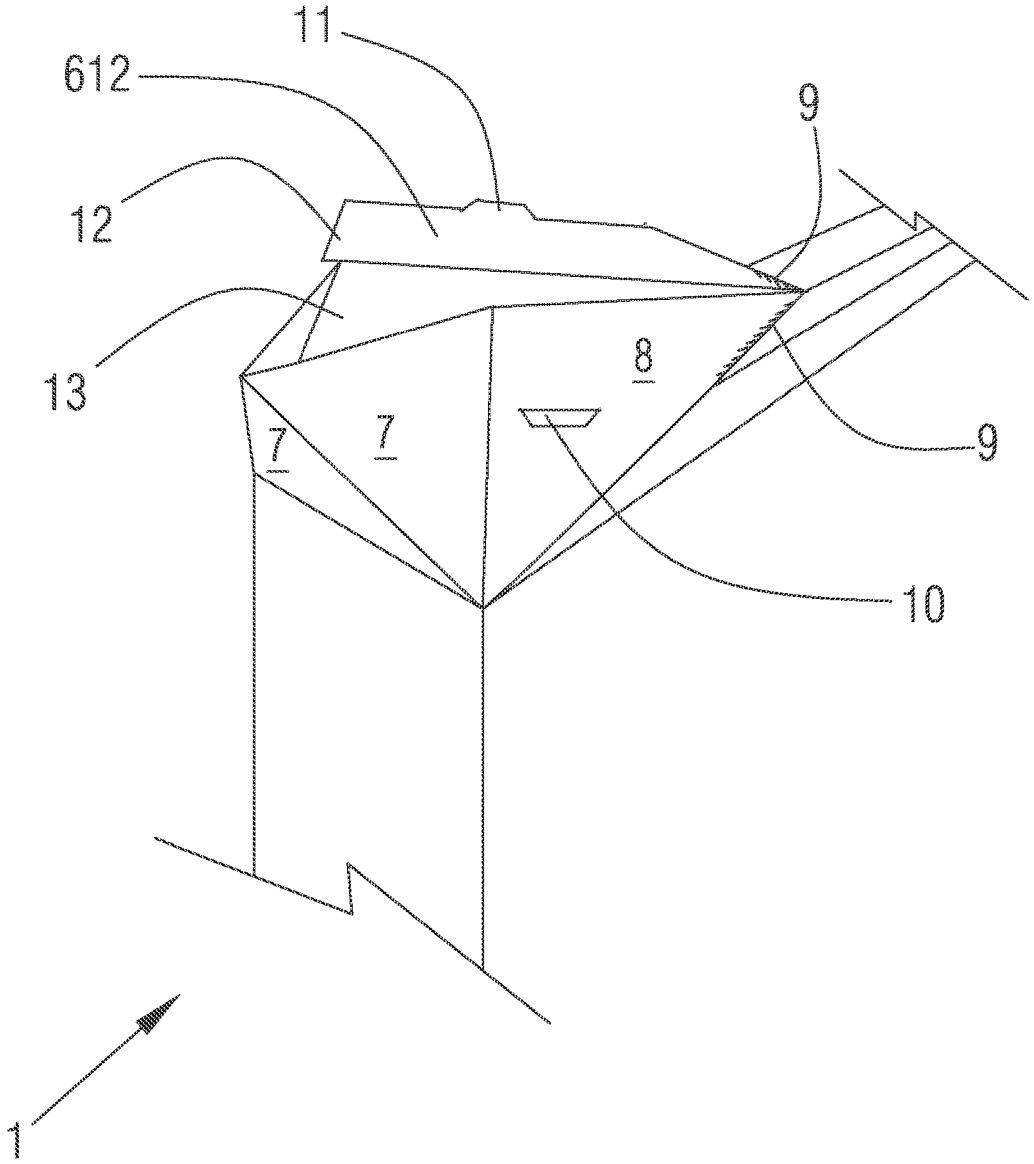

The portion 7 must then be moved towards the outside of the vessel 1 so that it thus finally creates the opening 13, as shown schematically in FIGS. 5 and 6.

Figure 7:
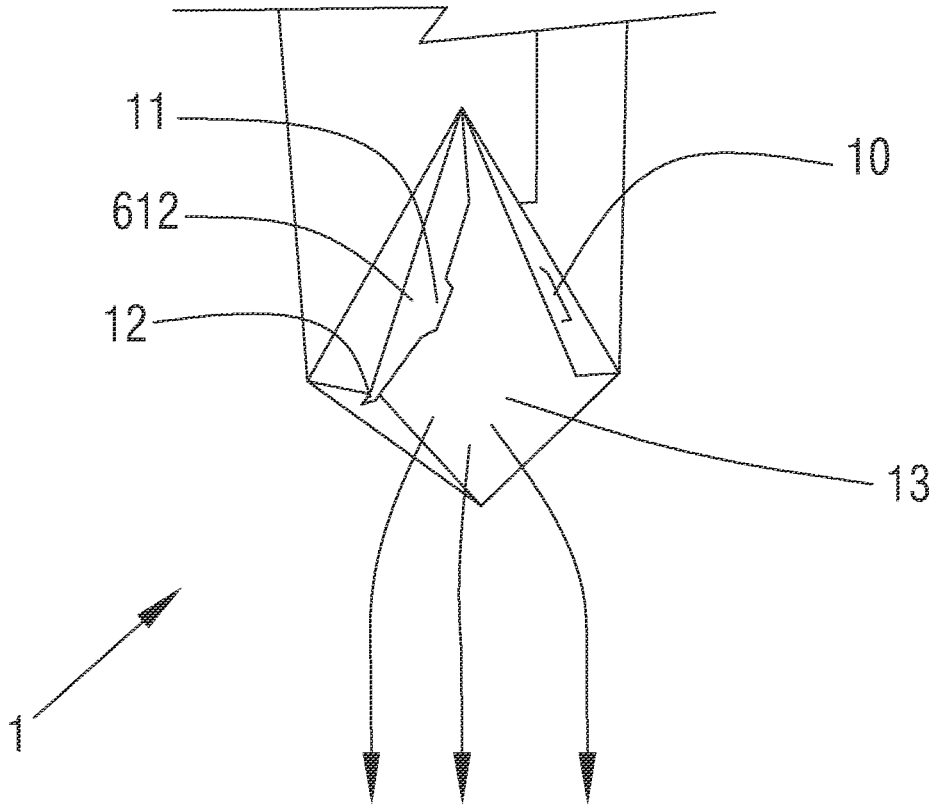

With the opening 13 having been created in this way, the granulated or liquid content inside the vessel 1 may easily be released, it only being necessary to appropriately move and position said vessel 1 so that the opening 13 is appropriately oriented downwards in order to enable the outlet of said content due to the action of gravity, as shown schematically by the arrows in FIG. 7.

The special arrangement of the opening 13 enables said outlet of the content or product housed inside the vessel 1 to be suitably controlled and channelled.

To close the opening 13, the reverse operation to that explained above must be carried out, that is, the portion 7 must be moved towards the inside of the vessel 1 in order to return to the situation of FIG. 4.

Figure 8:
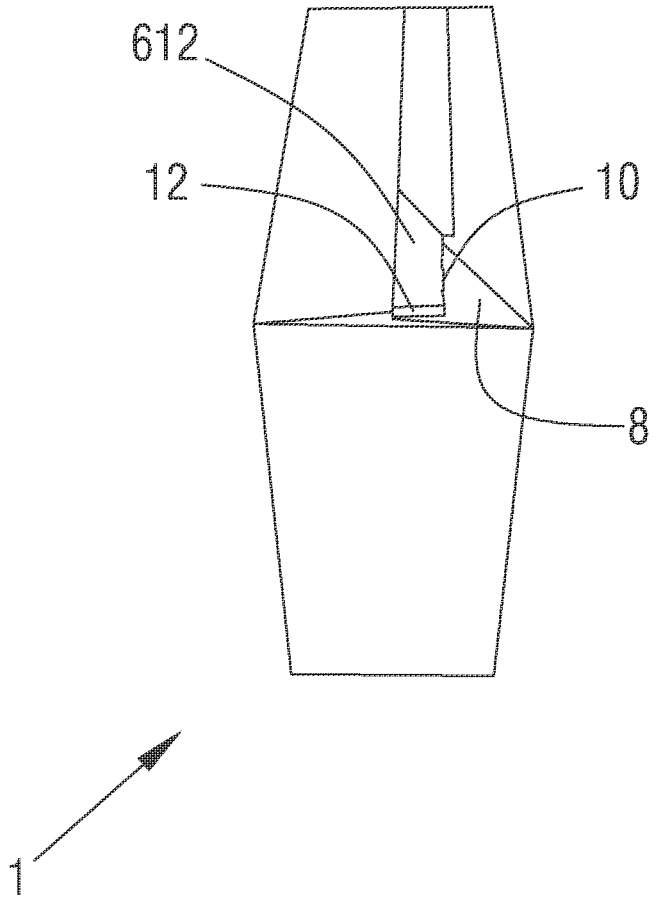

Then, the tab 11 must be manually inserted and adjusted in the slot 10, to ensure the permanent closure of the opening 13, the vessel 1 remaining a shown schematically in FIG. 8, with the tab 11 inserted in the slot 10 and in storage conditions.

In order to successively open or close the opening 13 again, the tab 11 need only be manually removed from or inserted and adjusted in, depending on the case, the slot 10 and the unfolding or folds described above carried out, since the adhesive glue has already been initially torn and the tear line 9, having also been previously torn, does not perform any function either.

Figure 9:
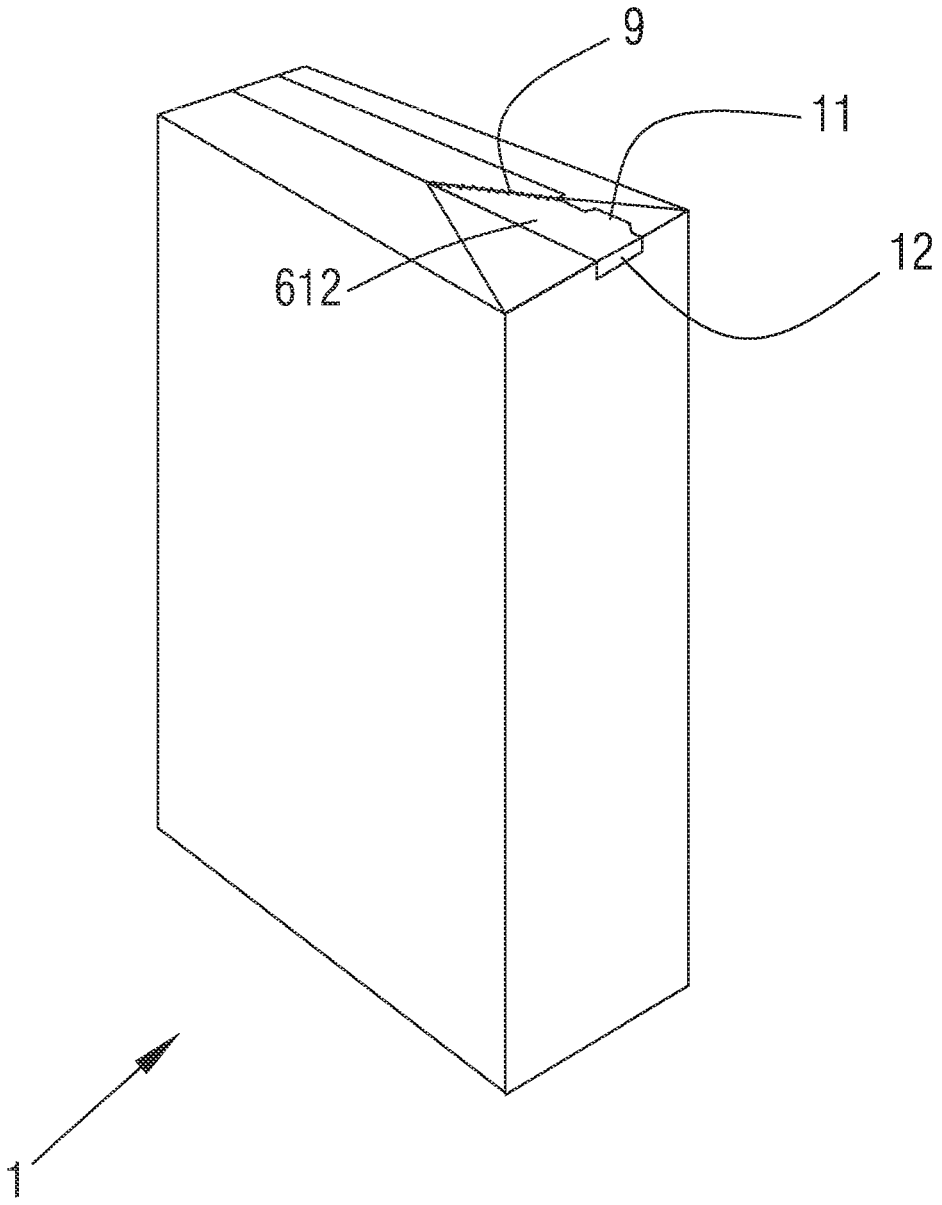
FIG. 9 is a schematic and perspective view of another preferred embodiment of the container with fold-out opening of the present invention, before the manipulation and manual use thereof by the user.

In a preferred embodiment and in a condition prior to the use of the container with fold-out opening of the invention, the tongue 12 is bent and/or adhered on a lateral side adjacent to the vessel 1, as shown schematically in FIG. 9, and with the tab 11 inserted in the slot 10.

This prevents possible leaks of the inner granulate or liquid product in the area of the vessel 1 in which the tongue 12 is bent.

The present invention enables the manual opening of a vessel of the type commonly used for storing and dispensing granulated or liquid contents or products, and the subsequent closing thereof, which is also manual, successively, simply, effectively and securely for the uses of the user.

The particular arrangement of the created and resulting opening 13 enables the user to carry out a dosage and pouring of the granulated or liquid product contained inside said vessel 1 with greater accuracy in accordance with their particular needs, unlike the possibilities of the current state of the art.

The specific creation of the opening 13 in the upper base of the vessel 1, enables the free surface of the granulated or liquid product contained inside said vessel 1 to be almost touching or reaching said upper base, thus meaning that the useful volume of the vessel 1 containing the inner granulated or liquid product is almost the same as the inner geometric volume of said vessel 1.

Said circumstance is a considerable advantage with respect to other vessels used in the state of the art, wherein the arrangements of the opening systems used that invade the lateral sides of the vessel reduce the useful volume with respect to the existing geometric volume.

This entails significant and clear advantages in the production costs, inner storage capacity, etc.

The details, shapes, dimensions and other accessory elements, as well as the materials used to manufacture the container with fold-out opening of the invention, may be suitably substituted for others which are technically equivalent, and do not diverge from the essential nature of the invention, nor the scope defined by the claims included below.

What is claimed is:

1. A container with fold-out opening, of the type used for storing and dispensing granulated or liquid products, which comprises a vessel (1) with a parallelepiped rectangular configuration with an upper base and a lower support base, said vessel (1) resulting from suitable bending and folding of a laminar body (2), the laminar body (2) having transversal bending lines that define a first rectangular wall (21), a second rectangular wall (22), a third rectangular wall (23) and a fourth rectangular wall (24) arranged adjacent to each other, which have an upper flap (3) that is common to the first, second, third and fourth rectangular walls (21, 22, 23, 24) and that defines the upper base of the vessel (1), and have a lower flap (4) common to the first, second , third, and fourth rectangular walls (21, 22, 23, 24) that is equipped with bending lines, which defines the lower support base of the vessel (1); characterised in that the upper flap (3) has two folding lines (31) that continue two transversal bending lines (231) defining the third rectangular wall (23) that is in a central position; said folding lines (31) defining a first rectangular portion (6), a second rectangular portion (7) and a third rectangular portion (8) of the upper flap (3) and being prolongations of each one of the second, third and fourth rectangular walls (22, 23, 24) respectively; the second rectangular portion (7) having a central position and having a same axis of symmetry (5) as the third rectangular wall (23) and being a continuation of the third rectangular wall (23); and the first and third rectangular portions (6, 8) each having a lateral position and being symmetrical with respect to the axis of symmetry (5) and being a continuation of the second and fourth rectangular walls (22, 24); each of the first and third portions (6, 8) being provided with a first addition (61) and a second addition (81) respectively on edges opposite contact thereof with the second the fourth rectangular walls (22, 24); the first addition (61) having a transversal tear line (9) that divides the first addition (61) into a first dividing part (611) and a second dividing part (612), one being further from the axis of symmetry (5) of the third rectangular wall (23) than the other, and the second addition (81) having a free edge (84) that is symmetrical to the tear line (9) with respect to the axis of symmetry (5); the third rectangular portion (8) having a slot (10) close to the second rectangular portion (7), and the first addition (61) having a tab (11) in the second dividing part (612) thereof closest to the second rectangular portion (7) and which can be engaged and inserted into the slot (10).

2. The container with fold-out opening according to claim 1, characterised in that the two folding lines (31) of the upper flap (3) are symmetrical with respect to the axis of symmetry (5) of the third rectangular wall (23) that is in a central position in the laminar body (2).

3. The container with fold-out opening according to claim 1, characterised in that the second rectangular portion (7) of the upper flap (3) has two folding lines (71,72) that define three triangles, two of them being right-angled triangles, and the first and third rectangular portions (6, 8) each have folding lines (62, 82) that define a right-angled triangle adjacent to the second rectangular portion (7), the slot (10) in the right-angled triangle being created by one of the folding lines (82), the second addition (81) being trapezoidal shaped with the free edge (84) thereof closest to the second rectangular portion (7) being arranged such that it provides a wedge shape to the second addition (81).

4. The container with fold-out opening according to claim 3, characterised in that the first and third rectangular portions (6, 8) and the first and second additions (61,81) have folding lines (63, 83) respectively interposed therebetween and that simultaneously delimit the separation thereof, and which are perpendicular to the axis of symmetry (5).

5. The container with fold-out opening according to claim 4, characterised in that the tear line (9) starts its path at the intersection point between the folding line (62) and the other folding line (63) interposed between the first rectangular portion (6) and the first addition (61).

6. The container with fold-out opening according to claim 3, characterised in that the folding lines (71,72) are symmetrical with respect to the axis of symmetry (5).

7. The container with fold-out opening according to claim 3, characterised in that the folding lines (62, 82) are symmetrical with respect to the axis of symmetry (5).

8. The container with fold-out opening according to claim 3, characterised in that the folding lines (62, 82) start their path at the connection point and continue the bending lines (231) with the folding lines (31).

9. The container with fold-out opening according to claim 3, characterised in that the two folding lines (71,72) start their path at the connection point and continue the bending lines (231) with the folding lines (31).

10. The container with fold-out opening according to claim 1, characterised in that the second dividing part (612) of the first addition (61) closest to the axis of symmetry (5) has a tongue (12).

11. The container with fold-out opening according to claim 10, characterised in that in a condition prior to the use thereof, the tongue (12) is bent and/or adhered on a lateral side adjacent to the vessel (1).

12. The container with fold-out opening according to claim 1, characterised in that the first and third rectangular walls (21, 23) are equal to each other, and the other second and fourth rectangular walls (22, 24) are also equal to each other.

13. The container with fold-out opening according to claim 1, characterised in that the first dividing part (611) of the first addition (61) resulting from the path of the tear line (9) and that is furthest from the axis of symmetry (5), is symmetrical with the second addition (81) with respect to the same axis of symmetry (5).

14. The container with fold-out opening according to claim 1, characterised in that in a condition prior to the use thereof, the vessel (1) has the second dividing part (612) adhered to the third rectangular portion (8) by means of a joining means.

15. The container with fold-out opening according claim to 14, characterised in that the joining means comprises adhesive glue.

16. The container with fold-out opening according to claim 1, characterised in that in a condition of use, the vessel (1) has an opening (13) delimited by the first, second and third rectangular portions (6, 7, 8).

17. The container with fold-out opening according to claim 1, characterised in that in a condition prior to the use thereof, the tab (11) is engaged and inserted in the slot (10).

* * * * *